US005289358A

United States Patent [19]

Halemeier

[11] Patent Number: 5,289,358

[45] Date of Patent: Feb. 22, 1994

[54] RECESSED LUMINAIRE WITH A SWIVEL HOUSING

[75] Inventor: Eckard Halemeier, Hiddenhausen, Fed. Rep. of Germany

[73] Assignee: Halloform GmbH & Co., KG, Hiddenhausen, Fed. Rep. of Germany

[21] Appl. No.: 878,262

[22] Filed: May 4, 1992

[30] Foreign Application Priority Data

May 3, 1991 [DE] Fed. Rep. of Germany ..... 4114509

[51] Int. Cl.[5] ..... F21V 21/04

[52] U.S. Cl. ..... 362/365; 362/269; 362/275; 362/287; 362/419

[58] Field of Search ..... 362/269, 275, 287, 364, 362/372, 366, 418, 427, 365, 367, 419

[56] References Cited

U.S. PATENT DOCUMENTS

Re. 17,545 12/1929 Nenzel ..... 362/269

2,431,491 11/1947 Lee et al. ..... 362/137

2,595,011 4/1952 Singer ..... 362/269

4,623,956 11/1986 Conti ..... 362/148

4,628,417 12/1986 Kaminski et al. ..... 362/427

4,722,032 1/1988 Kulka ..... 362/365

5,145,249 9/1992 Bruckner ..... 362/364

FOREIGN PATENT DOCUMENTS 4016531 11/1991 Fed. Rep. of Germany .

*Primary Examiner*—Ira S. Lazarus

*Assistant Examiner*—L. Heyman

*Attorney, Agent, or Firm*—Foley & Lardner

[57] ABSTRACT

A recessed luminaire having a first housing and a second housing. The second housing has a light holder and a reflector disposed therein, the reflector having an edge portion defining an open end. The first and second housings are connected by a joint, located at the edge portion of the reflector, which allows the second housing to swivel into and out of the first housing.

8 Claims, 5 Drawing Sheets

RECESSED LUMINAIRE WITH A SWIVEL HOUSING

BACKGROUND OF THE INVENTION

1. Field of the Invention

The invention relates to a recessed luminaire having a swivel housing which is mounted in a built-in housing, and more particularly to a halogen recessed luminaire which can be placed into cup-shaped holes in pieces of furniture, ceiling panels and the like.

2. Description of the Related Art

In conventional recessed luminaires, the reflector, or a housing accommodating the reflector together with the holder for the halogen lamp, can be swiveled about an axis extending diametrically through the light exit opening. The swiveling arrangement is mounted in a rotatable ring or housing, thereby allowing the direction of radiation of the reflector to be set to any desired angle within a conical three-dimensional angular range by the superimposition of the swiveling and rotary movements. The ring or the rotatable housing is inserted into the built-in housing which results in a relatively large installation depth and a limited swiveling range for the reflector. The light is connected electrically via flexible cables which can follow the swiveling movements. The holder for the halogen luminaire is arranged centrally in the reflector, making an excessively large length of cable unnecessary regardless of the swiveling position. In this arrangement, the longitudinal axis of the halogen lamp coincides with the axis of the reflector. The reflector must therefore have a relatively great depth in order to allow the halogen lamp to be accommodated completely in the reflector and to avoid the dazzling of an observer outside the immediate range of radiation of the luminaire.

On the other hand, halogen luminaires with a smaller installation depth are known. These halogen lamps are arranged obliquely or at right angles to the axis of the reflector. In the known luminaires of this design, there is, however, no possibility of varying the direction of radiation.

SUMMARY OF THE INVENTION

An object of the invention is to provide a recessed luminaire in which the direction of radiation of the reflector can be varied while having a small installation depth.

The above object is met by providing a recessed luminaire having a first housing with an open side, and a second housing. A reflector having an edge portion defining an open end thereof is disposed in the second housing. A light holder is also disposed in the second housing. Furthermore, a joint connects the first housing to the second housing at the edge portion of the reflector, thereby allowing the second housing to swivel into and out of the first housing open side.

The above-mentioned joint which forms the swiveling axis of the swivel housing for the reflector is situated at the edge of the light exit opening of the reflector. The swivel housing can thus be swiveled out of the built-in housing by an angle of up to 90°. In this way, a large swiveling angle is achieved despite a small installation depth.

A further reduction in the installation depth can be achieved by positioning the light holder obliquely relative to the axis of the reflector. The holder for the light is also offset towards the joint, thus defining a circular arc with only a relatively small radius during its swiveling movement. In this way, the electrical connection of the light is made unproblematic despite the wide swiveling angle.

The joint can also preferably be provided with sliding contacts, allowing the connection of the light to be effected without cables. The moving parts of the joint are under a stress which allows the swivel housing to be held nonpositively in any desired angular position. The contact pressure forces required for this purpose simultaneously guarantee a good electrical contact.

A pull tab situated opposite the joint can also be provided and serve to simplify the handling of the swivel housing, and simultaneously makes it possible to secure, in a simple manner, a retention ring which holds an attachment or a protective glass, in front of the light exit opening.

The stated object can also be med by providing a recessed luminaire having a first housing with first and second portions that are connected to each other. The first housing has a plurality of side walls and an encircling undercut in the inner surface of the sidewalls. A second housing is also provided and has a collar which is disposed in the undercut such that the second housing is rotatably mounted in the first housing. A third housing is mounted in the second housing such that it can swivel therein. A reflector and a light holder are disposed in the third housing. Since the rotary housing is held by a collar projecting from its circumference which engages with an undercut in the built-in housing, it need not be fixed at its front edge by retention means, and can therefore project forwards out of the opening of the built-in housing. Accordingly, a shade ring, which screens the edge of the built-in housing, can be secured to the rotary housing in a manner which allows it to rotate therewith. The shade ring thus simultaneously serves as a handle for rotating the rotary housing. Moreover, the built-in housing can be divided into two half shells along its diameter, thereby allowing it to be manufactured as an injection-molded plastic part despite the undercuts on its inner circumference.

BRIEF DESCRIPTION OF THE DRAWINGS

Other objects, features and advantages of the present invention will become apparent from the following detailed description and accompanying drawings wherein.

DETAILED DESCRIPTION OF THE PREFERRED EMBODIMENTS

Figure 1:
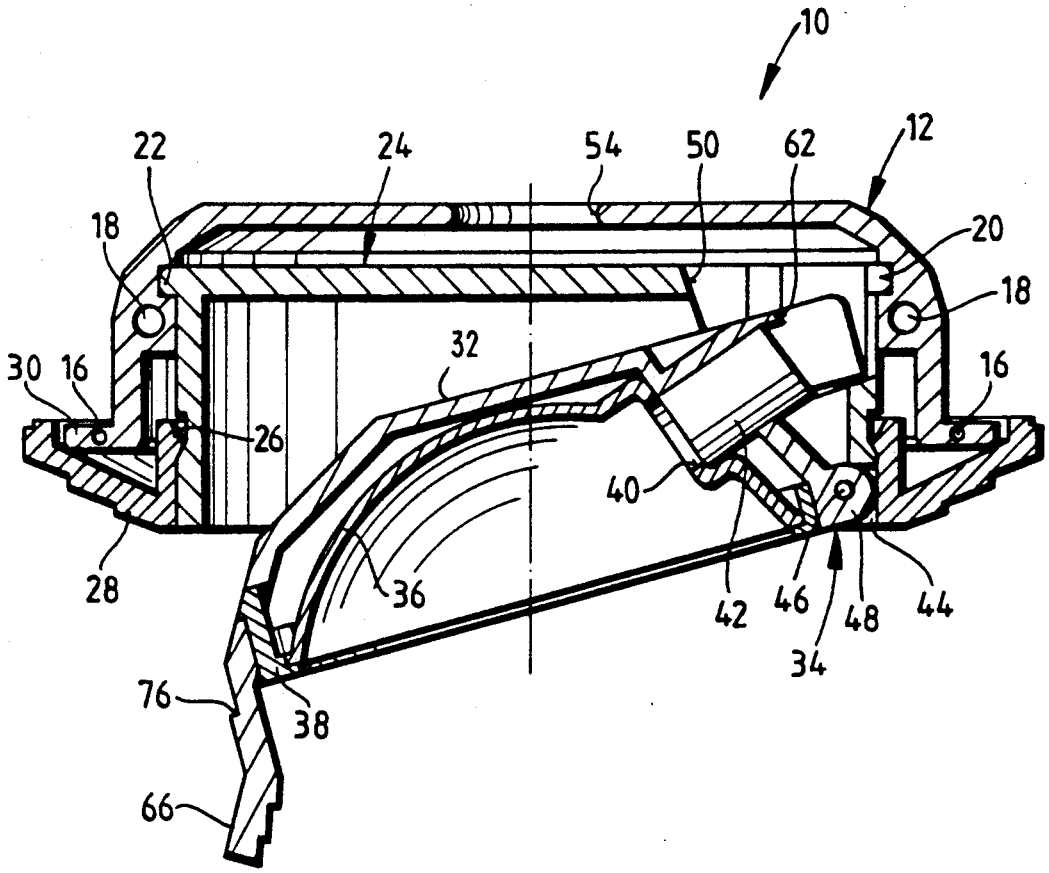
FIG. 1 is a sectional view through a recessed luminaire showing a swivel housing partially swiveled outward from the built-in housing.
Figure 2:
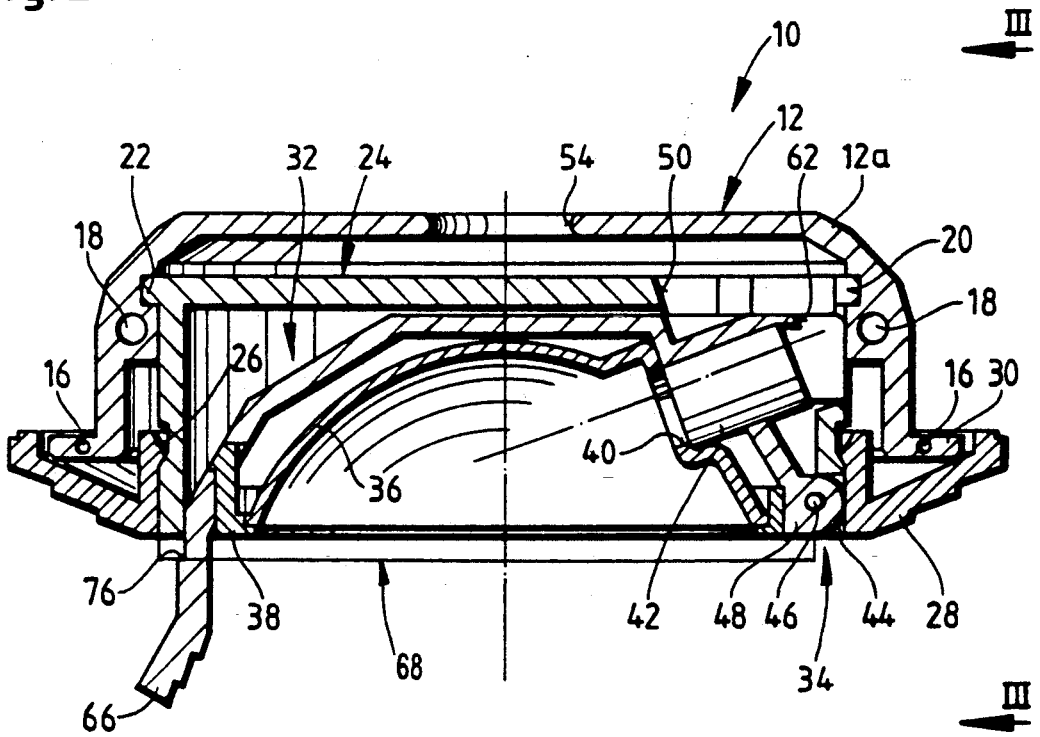
FIG. 2 is a sectional view through the recessed luminaire showing the swivel housing retracted into the built-in housing.
Figure 3:
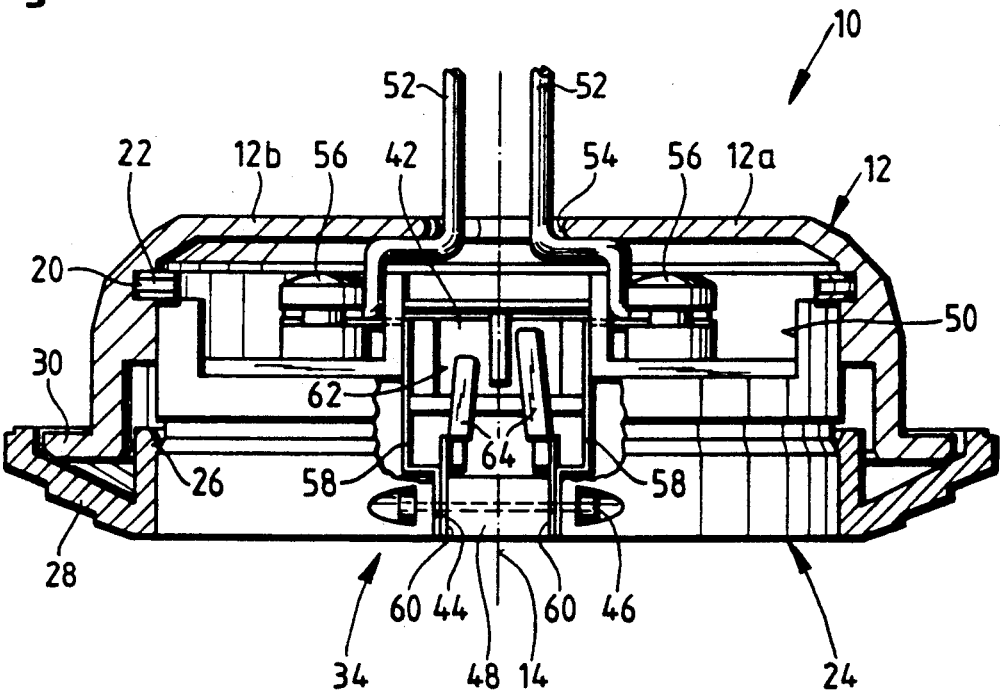
FIG. 3 is a partial sectional view of the recessed luminaire as viewed along arrows III—III of FIG. 2.
Figure 6:
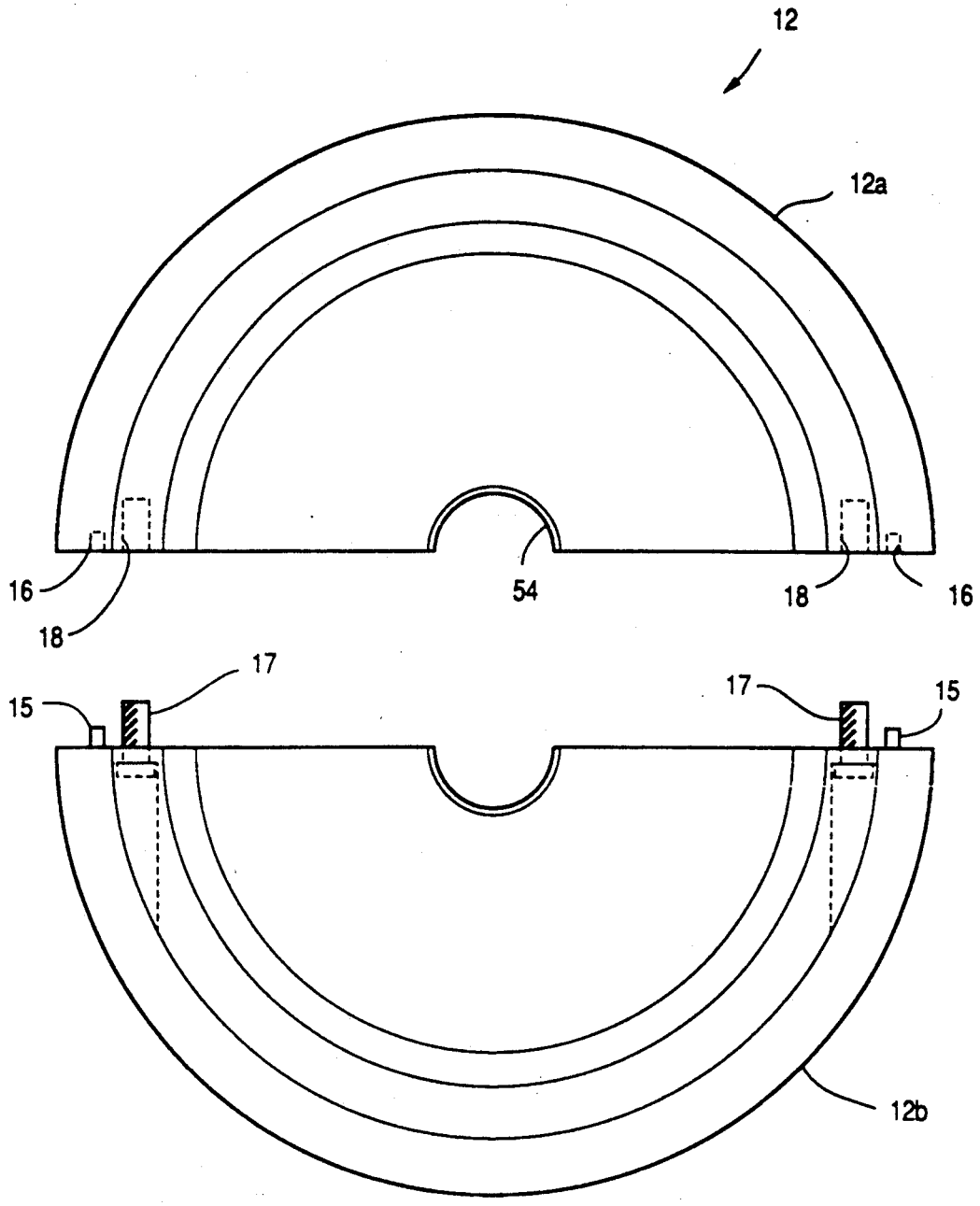
FIG. 6 is an exploded top plan view of a recessed luminaire.

According to FIGS. 1 to 3, the recessed luminaire 10 has a cup-shaped built-in housing 12, which is divided, by a plane 14 (FIG. 3) lying parallel to the plane of projection in FIG. 1, into two virtually identical half shells 12*a*, 12*b* which are connected to one another by tongues and grooves (not shown), or by integrally molded dowels 15 and associated dowel holes 16, and are held together by screws extending tangentially, in the circumferential wall. The screw holes 18 for the screws 17 (FIG. 6) be seen in FIGS. 1 and 2. On its inside, the built-in housing 12 has an undercut 20 which runs around the inner circumferential wall and into which there engages a collar 22 of a cup-shaped rotary housing 24. In this way, the rotary housing 24 is held such that it can be rotated in the built-in housing 12 and such that it projects with its open end out of the opening in the built-in housing 12. Snapped onto the open end of the rotary housing 24 by means of snap-in projections 26 is a conical shade ring 28 which overlaps the edge 30 of the built-in housing 12. By means of the snap-in connection, the shade ring 28 is connected firmly, in terms of rotation, to the rotary housing 24, making it easy to rotate the rotary housing with the aid of the shade ring 28.

A swivel housing 32 is connected to the edge of the rotary housing 24 via a joint 34 such that it can be swiveled. FIG. 2 shows the swivel housing 32 in a position in which it is accommodated completely in the rotary housing 24. In FIG. 1, the swivel housing 32 is swiveled partially out of the rotary housing 24. However, the swivel housing can be swiveled beyond the position shown in FIG. 1, and into a position in which it is oriented virtually at right angles to the rotary housing 24. Arranged in the swivel housing 32 is a reflector 36. The reflector 36 is held by a snap ring 38 in a snap-lock engagement with the swivel housing 32. In a position offset towards the joint 34 relative to its axis of symmetry, the reflector 36 has an opening 40 which allows a halogen lamp (not shown) to be inserted into a holder 42 in such a way that it extends obliquely from the axis of symmetry of the reflector, and such that its coil is located approximately in the focal point of the reflector. The holder 42 is inserted into the swivel housing 32 and is held in position by the reflector 36.

In the region of its edge, the rotary housing 24 has a recess 44 through which the hinge pin 46 of the joint 34 passes. A hinge part 48 of the swivel housing 32 is inserted into the recess 44 under stress, such that the swivel housing 32 can be held nonpositively in any desired angular position. Adjoining the recess 44 of the rotary housing 24 towards the top is a larger recess 50 which accommodates the electrical connection devices for the holder 42. According to FIG. 3, two connection cables 52 pass through a central opening 54 in the top of the built-in housing 12 and connect to terminals 56 which are arranged on the rotary housing 24. Emanating from the terminals 56 are conductive metal plates 58 which extend into the recess 44 and press against metal plates 60 arranged on the end walls of the hinge part 48. The metal plates 60 are wired permanently to the rear side of the holder 42, the rear side of holder 42 being accessible through an opening 62 in the swivel housing. The connection wires 64 connecting the metal plates 60 to the rear side of holder 42 can be seen in FIG. 3. By means of the metal plates 58 and 60, which serve as sliding contacts, a conducting connection to the holder 42 is created without the need for flexible cables to compensate for the swiveling movement of the swivel housing 32. Even in the fully extended position of the swivel housing 32, there are no visible cables in the rotary housing 24 which would spoil the visual appearance of the luminaire.

On the side opposite the joint 34, the swivel housing 32 is provided with a pull tab 66 which allows the swivel housing to be grasped in the basic position shown in FIG. 2 and swiveled out of the rotary housing.

Figure 4:
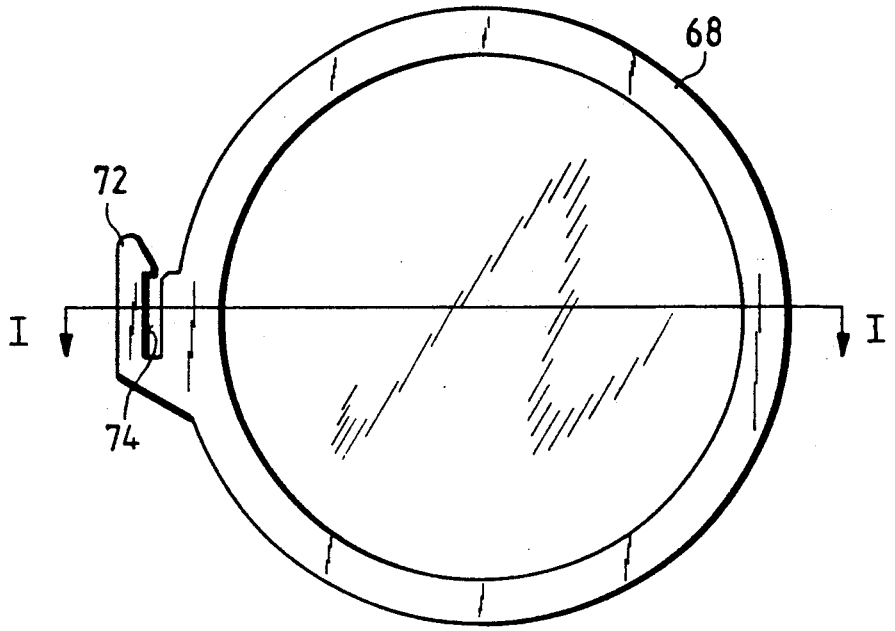
FIG. 4 is a top plan view of a retention ring.
Figure 5:
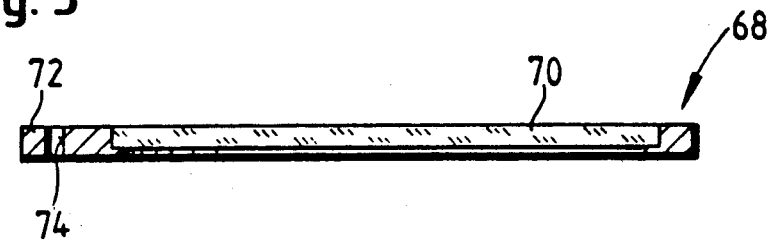
FIG. 5 is a sectional view of the retention ring along line I—I of FIG. 4, the retention ring having a protective glass secured therein.

In some cases, it is desirable to cover the light exit opening of the reflector 36 with a protective glass or an attachment in the form of a tapered dome or the like. FIGS. 4 and 5 show a retention ring 68, into which is inserted, for example, a protective glass 70. Arranged at the rim of the retention ring 68 is a snap-in claw 72, which forms a gripping slot 74 with the main part of the retention ring. Formed on the outer surface of the pull tab 66 is a step 76, the distance of which from the surface of the snap ring 38 corresponds to the thickness of the snap-in claw 72. The thickness of the pull tab 66 in the base region above the step 76 corresponds to the width of the gripping slot 74. The retention ring 68 can be clamped onto the pull tab 66 with the aid of the snap-in claw 72. The snap-in claw will therefore rest behind the step 76 of the pull tab. The retention ring 68 then rests snugly over its entire circumference against the surface of the snap ring 38. The angle between the pull tab 66 and the plane of the snap ring 38 is preferably slightly less than 90°, with the result that the retention ring 68 is held under tension against the snap ring 38. However, if required, this prestress can also be achieved if that part of the retention ring which forms the gripping slot 74 and the snap-in claw 72, is angled slightly relative to the main part of the retention ring 68.

While specific embodiments of the invention have been described and illustrated, it will be understood that variations in the details of the embodiments specifically illustrated and described may be made without departing from the true spirit and scope of the invention.

What is claimed is:

1. A recessed luminaire comprising:
a first housing having an open side;
a second housing;
a reflector having an edge portion defining an open end, said reflector being disposed in said second housing;
a light holder disposed in said second housing; and
a joint connecting said first housing to said second housing at said edge portion of said reflector, said joint allowing said second housing to swivel into and out of said first housing open side;
wherein said second housing comprises a pull tab which is situated diametrically opposite said joint and which projects out of said first housing.

2. A recessed luminaire as claimed in claim 1, wherein said light holder is offset towards said joint relative to an optical axis of the reflector.

3. A recessed luminaire as claimed in claim 1, wherein said joint comprises a plurality of sliding contacts which are electrically connected to said light holder.

4. A recessed luminaire as claimed in claim 1, wherein said joint comprises first and second cooperating parts which are stressed relative to each other and which can move relative to each other such that said second housing can be held non-positively in a plurality of angular positions.

5. A recessed luminaire as claimed in claim 1, further comprising a retention ring for supporting a protective covering, said retention ring having a snap-in claw on its outer circumference which is clamped to said pull tab such that the inner circumference of said retention ring rests against said edge portion of said reflector.

6. A recessed luminaire comprising:

a first housing having first and second portions which are connected to each other, said first housing having a plurality of side walls and an encircling undercut in the inner surface of said sidewalls;

a second housing having a collar, said collar being disposed in said undercut such that said second housing is rotatably mounted in said first housing;

a third housing mounted in said second housing such that it can swivel therein;

a reflector and a light holder disposed in said third housing; and a shade ring which overlaps the first housing and which is connected to said second housing such that said shade ring rotates with said second housing.

7. A recessed luminaire according to claim 6, wherein said first and second portions are connected by screws.

8. A recessed luminaire according to claim 6, wherein said first and second portions are connected by snap-locks.

* * * * *